US011178942B2

(12) United States Patent
Daga et al.

(10) Patent No.: US 11,178,942 B2
(45) Date of Patent: Nov. 23, 2021

(54) CUSTOMIZABLE JEWELLERY ARTICLES

(71) Applicant: SHRI SHUBHAM Limited, Hong Kong (CN)

(72) Inventors: Abhinav Daga, Mumbai (IN); Andrea Ponti, Kowloon (HK)

(73) Assignee: SHRI SHUBHAM LIMITED, Hong Kong (CN)

( * ) Notice: Subject to any disclaimer, the term of this patent is extended or adjusted under 35 U.S.C. 154(b) by 0 days.

(21) Appl. No.: 16/335,544

(22) PCT Filed: Sep. 20, 2017

(86) PCT No.: PCT/IB2017/055686
§ 371 (c)(1),
(2) Date: Mar. 21, 2019

(87) PCT Pub. No.: WO2018/055517
PCT Pub. Date: Mar. 29, 2018

(65) Prior Publication Data

US 2019/0343245 A1 Nov. 14, 2019

(30) Foreign Application Priority Data

Sep. 22, 2016 (GB) ..... 1616113

(51) Int. Cl.
*A44B 11/25* (2006.01)
*A44C 5/20* (2006.01)
(Continued)

(52) U.S. Cl.
CPC ..... *A44C 5/2052* (2013.01); *A44C 11/002* (2013.01); *A44C 13/00* (2013.01);
(Continued)

(58) Field of Classification Search
CPC ..... Y10T 24/45628; Y10T 24/45743; Y10T 24/45518; Y10T 24/45476;
(Continued)

(56) References Cited

U.S. PATENT DOCUMENTS 2,580,769 A 1/1952 Harman
4,425,689 A * 1/1984 Fildan ..... A44B 11/263 24/616

(Continued)

FOREIGN PATENT DOCUMENTS

CN 204218135 U 3/2015
DE 1087388 B 8/1960

(Continued)

OTHER PUBLICATIONS

ISR dated Mar. 29, 2018 for PCT/IB2017/055686.
Search Report dated Mar. 14, 2017 for GB2553593.

*Primary Examiner* — Robert Sandy
*Assistant Examiner* — Michael S Lee
(74) *Attorney, Agent, or Firm* — Christopher M. Ramsey; GrayRobinson, P.A.

(57) ABSTRACT

A jewelry clasp includes a female end component having a first push-button fastening means and a male end component that is releasably securable within the female end component. The male end component has a second push-button fastening means that engages a portion of the first push-button fastening means. The engaging portion of the first push-button fastening means is movable between a locked position and an unlocked position. An ornamental component for jewelry that has an elongate member includes a housing, a channel passing through the housing, and a slot within the housing. The slot is substantially parallel to the channel and passes through a wall of the housing to the channel.

14 Claims, 4 Drawing Sheets

(51) Int. Cl.

| | |
|---|---|
| ***A44C 11/00*** | (2006.01) |
| ***A44C 13/00*** | (2006.01) |
| ***A44C 15/00*** | (2006.01) |
| ***A44C 17/02*** | (2006.01) |

(52) U.S. Cl.
CPC ..... *A44C 15/005* (2013.01); *A44C 17/0208* (2013.01); *Y10T 24/45529* (2015.01)

(58) Field of Classification Search
CPC ..... Y10T 24/45482; Y10T 24/45524; Y10T 24/45602; Y10T 24/45623; A44B 11/263; A44B 11/2511; A44C 5/2052; A44C 11/002; A44C 13/00; A44C 15/005; A44C 17/0208
See application file for complete search history.

(56) References Cited

U.S. PATENT DOCUMENTS

| | | | | |
|---|---|---|---|---|
| 5,170,541 | A * | 12/1992 | Chen | A45C 13/26 24/613 |
| 5,433,088 | A | 7/1995 | Mahar | |
| 5,440,900 | A | 8/1995 | White | |
| 8,677,575 | B1 * | 3/2014 | Bergstrom | A44B 11/266 24/615 |
| 9,578,930 | B2 * | 2/2017 | Koreishi | A44B 11/006 |
| 2005/0183249 | A1 | 8/2005 | Ninomiya | |
| 2005/0265132 | A1 * | 12/2005 | Ho | G04B 37/1486 368/282 |
| 2007/0214617 | A1 * | 9/2007 | Niwa | A44B 11/263 24/615 |
| 2007/0271739 | A1 | 11/2007 | Slautterback | |
| 2015/0359301 | A1 | 12/2015 | Lavorato et al. | |
| 2016/0037870 | A1 * | 2/2016 | Perkins | A44B 17/0011 24/664 |
| 2016/0037876 | A1 * | 2/2016 | Perkins | A44C 5/14 224/164 |
| 2016/0069371 | A1 * | 3/2016 | Chen | F16B 21/12 403/326 |

FOREIGN PATENT DOCUMENTS

| | | | |
|---|---|---|---|
| EP | 0133068 | A1 | 2/1985 |
| EP | 1304943 | B1 | 1/2007 |
| EP | 1400875 | B1 | 7/2009 |
| EP | 2682016 | A1 | 1/2014 |
| FR | 803518 | A | 10/1936 |
| FR | 2547998 | B1 | 11/1987 |

* cited by examiner

CUSTOMIZABLE JEWELLERY ARTICLES

CROSS-REFERENCE TO RELATED APPLICATIONS

This is the U.S. National Stage entry of International Application No. PCT/IB2017/055686, filed Sep. 20, 2017, which claims the benefit of priority to GB Application No. 1616113.5, filed Sep. 22, 2016. These prior applications are incorporated herein by reference in their entirety.

FIELD

This invention pertains generally to the field of customizable jewelry articles, and in particular jewelry articles such as bracelets and necklaces that incorporate interchangeable ornamental components.

BACKGROUND

There is a growing trend in customizing jewelry articles, and being able to display on a bracelet or necklace, ornamental components that a wearer has selected. These ornamental components, often described as charms, allow for a wearer to interchange them to suit their attire, a particular mood, or to signify important events in their life. They allow the ornamental components to be bought separately and added on, bought by self-selection, given as gifts and to allow the user full control over what they wish to display at any one time. The most common type of jewelry article that incorporates such freedom of customization is known as a charm bracelet.

However, whilst there are a number of charm bracelets already on the market, these typically require that the clasp be removed or altered in some way to allow each ornamental component to be added to the bracelet or string. To rearrange the order of an array of ornamental components, typically a number of them would have to be removed, such as by unscrewing each one from the bracelet, and then re-strung. This adds some weakness to the clasp or fastener, in that it needs to either be small enough to pass through the stringing hole of the ornamental component, or it needs to have a means of removal from the string for stringing purposes. One method of achieving this is to allow the fastening means at the ends to be disconnected, thus allowing the ornamental component to pass.

Typically, these bracelets require that one of the end components of the fastener be unscrewed from the end of the string to thread on an ornamental component, then be re-screwed to the end of the string for refastening to the other end of the string to make a loop. With high value items on the string, both in terms of their monetary value and their emotional worth, the wearer must ensure that the clasp is full fastened. This system means that a wearer would be less likely to rearrange their charms as they saw fit, or they would make sure that they were in a place that they could fully remove the bracelet in order to add on any new ornamental components. This also means that if the ornamental component is to be placed in the middle of a bracelet, for an example, then all of those ornamental components already mounted to the bracelet would need to be removed. Therefore, whilst these existing bracelets do allow for some customization, the ease of performing the customization process is likely to deter a wearer from doing so all that often.

Typically, the clasps of existing bracelets and necklaces can prove to be somewhat fiddly. They require a certain level of finger dexterity to release a female end connector from the corresponding male end component. Particularly when the wearer is applying or removing the article on themselves. Such clasps and safety mechanisms are often intricate and awkward to operate. This is particularly true when trying to fasten bracelets, watch straps or the like, since fastening such articles needs to be carried out with only one hand.

Furthermore, the auxiliary fastening means are vulnerable and may be easily damaged during use. Their location on the sides of the fastening means can also detract from the overall design continuity of the jewelry piece.

There are a number of customizable bracelets and necklaces on the market with interchangeable ornamental components, or charms. Whilst these customizable bracelets and necklaces do go some way towards allowing for ease of interchangeability of charms, they do not appear to make the process of adding or rearranging ornamental components on the string safe and convenient.

The prior art shows a number of devices which attempt to address the needs in various ways.

US 2005 188 512 (Ninomiya) discloses a clasp for an article of jewelry with convenient release means on an exterior surface of the clasp, whereby the releaser projects from the body. The clasp requires that the releaser be pulled to release the pin from the body. Whilst going some way to improving the fiddliness of existing jewelry clasps, and providing a more convenient arrangement of releasing the clasp, one end of the clasp comprises a pin that must be located within the body, requiring dexterity of the user.

DE 102 014 002 448 (Thomas Sabo GmbH) discloses a closure for a piece of jewelry, that provides a convenient means of releasing the closure for removing the article of jewelry, by providing an actuator locking mechanism and spring loaded release button on the exterior surface of the closure. Whilst going some way towards improving upon the dexterity requirement for using the closure, and providing a reliable retention of the closure with a simple operation, the closure requires a shutter lock function to prevent accidental opening.

EP 2 682 016 (Pandora AS) discloses an ornamental component with gripping element. The ornamental component incorporates a through hole that allows the ornamental component to be strung on an elongated member of a bracelet or necklace. The through hole incorporates an insert assembly that comprises a tubular element and a gripping element to grip the elongate member. Whilst this disclosure proposes a means of placing and separating ornamental components on an elongate member of an article of jewelry, to add or remove ornamental components, or change their position in relation to another, the ornamental components must be unthreaded from the elongate member, and therefore the article of jewelry, and in some circumstances even the clasp, in order to do so. This does not provide a convenient means of interchanging, adding or replacing ornamental components, without the need to remove the article of jewelry. To rearrange the order of the ornamental components, all of those that are placed in line prior to the desired location, must be removed.

BRIEF SUMMARY

Preferred embodiments of the present invention aim to provide a customizable bracelet or necklace jewelry article, with interchangeable ornamental components, that allows for the rearrangement of existing ornamental components, addition of new ornamental components, without the need to unfasten the clasp of the bracelet or necklace. The present invention aims to provide a convenient clasp means that requires minimal dexterity to operate and is also an aesthetic feature in itself. It is an object of the present invention to provide an improved fastening means for securing together free ends of adjacent elements or adjacent ends of a single looped element, the fastening means having an integral auxiliary fastening means.

According to the present invention, there is provided a clasp for an article of jewelry that comprises an elongate member, the clasp comprising: a female end component for securing to a first end of the elongate member, the female end component incorporating a first push-button fastening means; and, a male end component for securing to a second end of the elongate member and configured to be releasably secured within the female end component, the male end component incorporating a second push-button fastening means that is configured to be operated by an engaging portion of the first push-button fastening means, whereby, in use, the engaging portion of the first push-button fastening means is movable between a locked position in which disengagement of said male end component from said female end component is prevented and an unlocked position in which disengagement of said male end component from said female end component is allowed.

Preferably, the first push-button fastening means may incorporate at least one biasing means, the at least one biasing means being configured to urge the engaging portion away from the second push button fastening means in the locked position.

Preferably, the second push-button fastening means may incorporate at least one biasing means, the at least one biasing means being configured to urge a surface portion of the second push-button fastening means into engagement with the engaging portion of the first push-button fastening means in the locked position.

Preferably, the at least one biasing means may comprise a spring.

The axes of the first push-button fastening means and the second push-button fastening means may be substantially perpendicular to the longitudinal axes of the female end component and the male end component respectively.

A push-button surface of the first push-button fastening means may be substantially flush with an exterior surface of the female end component when in a locked position.

The surface portion of the second push-button fastening means may protrude from an exterior surface of the male end component when in a locked position.

Preferably, the surface portion of the second push-button fastening means may be configured to prevent disengagement of the male end component from the female end component when in a locked position.

The surface portion may abut an interior surface of the female end component.

The engaging portion may be configured to disengage the surface portion from a locked position to an unlocked position, whereby the surface portion is substantially flush with an exterior surface of the male end component.

The male end component and/or the female end component may comprise a resilient material.

The resilient material may be an elastomer. The elastomer may be high density polyurethane.

Preferably, the female end component comprises at least one longitudinal slot, whereby, in use, the male end component is configured to mate within said at least one slot.

An article of jewelry having first and second opposable ends to be releasably joined together, the article of jewelry incorporating the clasp as hereinbefore described.

According to the present invention there is provided an ornamental component for an article of jewelry that comprises an elongate member, said ornamental component comprising: a housing; a channel passing through said housing for supporting the elongate member; and, a slot within the housing, said slot being configured to be substantially parallel to the channel and passing right through a wall of said housing to the channel, whereby, in use, said slot is configured to resist but allow the passing of the elongate member into the channel.

Preferably, the channel may incorporate a resilient lining.

Preferably, the slot may incorporate the resilient lining.

The resilient lining may incorporate at least one protrusion, whereby, in use, said at least one protrusion may prevent movement of the elongate member passing through the channel.

The protrusion may comprise a ridge formation.

The housing may comprise at least one recess within an exterior surface, said at least one recess being configured to support an ornamental element.

The resilient lining may incorporate at least one housing engaging projection on an exterior surface, and the housing may incorporate at least one corresponding recess within which the housing engaging projection can be secured.

The ornamental component may comprise a pair of collars, whereby each collar may be configured to be mounted to an exterior surface of the housing at either end of the channel.

The pair of collars may be configured to interconnect with one another within the channel.

The resilient lining may comprise a gripping element for frictionally gripping the elongate member.

The ornamental element may comprise one or more of the following materials: precious stone, marble, precious metal, granite.

The housing may comprise one or more of the following materials: metal, polymer, elastomer.

The resilient lining may comprise an elastomer.

An article of jewelry having first and second opposable ends to be releasably joined together, the article of jewelry incorporating at least one ornamental component as hereinbefore described.

BRIEF DESCRIPTION OF THE DRAWINGS

For a better understanding of the invention and to show how embodiments of the same may be carried into effect, reference will now be made, by way of example, to the accompanying diagrammatic drawings, in which.

In the figures like references denote like or corresponding parts.

DETAILED DESCRIPTION OF EXAMPLE EMBODIMENTS

Figure 1:
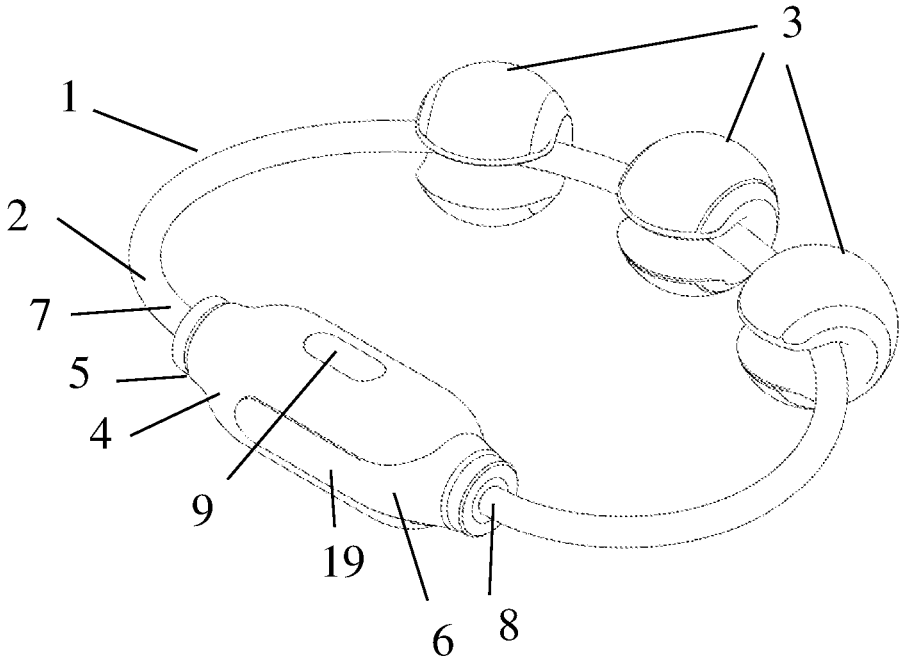
FIG. 1 shows an isometric view of one embodiment of jewelry article, showing an elongate member joined by a clasp, with the clasp in a closed and locked position, and a plurality of ornamental components mounted to the elongate member.

As shown in FIG. 1, an article of jewelry 1 incorporates an elongate member 2 or strand, a clasp 4 for securing a first end 7 to a second end 8 of the elongate member 2. This article of jewelry 1 may comprise a necklace, bracelet, anklet or similar item that comprises an elongate member 2 and a means of securing the first end 7 of the elongate member 2 to the second end 8 of the elongate member 2. The article of jewelry 1 may also comprise a ring, brooch, hair accessory or clip, belt, wearable electronics device or wristwatch. In some instances, the elongate member 2 may comprise a very short length, providing that the first end 7 can reach and therefore be releasably secured to the second end 8. The elongate member 2 may also display one or more ornamental components 3 in the form of charms, gemstones or similar items that can be releasably secured or mounted to the elongate member 2. The elongate member 2 may comprise, but is not limited to, a metal material such as gold, silver or platinum, or may alternatively comprise another material such as a woven textile, rope, leather, polymer, elastomer or suitable material for such an article of jewelry 1.

The clasp 4 is in itself intended to be of aesthetic value, whilst also providing a secure means of releasably securing a first end 7 of the elongate member 2 to a second end 8 of the elongate member 2. The clasp 4 has been configured to reduce the number of steps required to fasten the first end 7 to the second end 8, and to remove the first end 7 from the second end 8. The clasp 4 has been configured to allow the fastening and unfastening of the jewelry article 1 to be possible with minimal hand support from the user. In a number of circumstances this may be achieved using just one hand. The clasp 4 comprises a female end component 5 and a male end component 6 that is configured to be at least in part housed within the female end component 5. The female end component 5 and the male end component 6 are intended to be permanently secured to the first end 7 and second end 8 of the elongate member 2. The female end component 5 may comprise at least one slot 19 or cut-out through which the male end component 6 can be viewed. The male end component 6 may be configured to mate with and fit within the slot 19 such that the exterior surface of the female end component 5 and the exterior surface of the male end component 6 are flush when in an engaged or locked position.

The female end component 5 and the male end component 6 may be welded, soldered, glued or fixedly secured by another similar means to the first end 7 and the second end 8 of the elongate member 2 of the jewelry article 1. Additional elements such as one or more washers 13 may be required to support this joint. The clasp 4 in a locked condition may comprise in plan view a rectangular or oblong shape, circular shape, or triangular shape. The female end component 5 may comprise a substantially spherical housing, or alternatively a substantially cubic housing, neither of which are shown in the figures.

Figure 2:
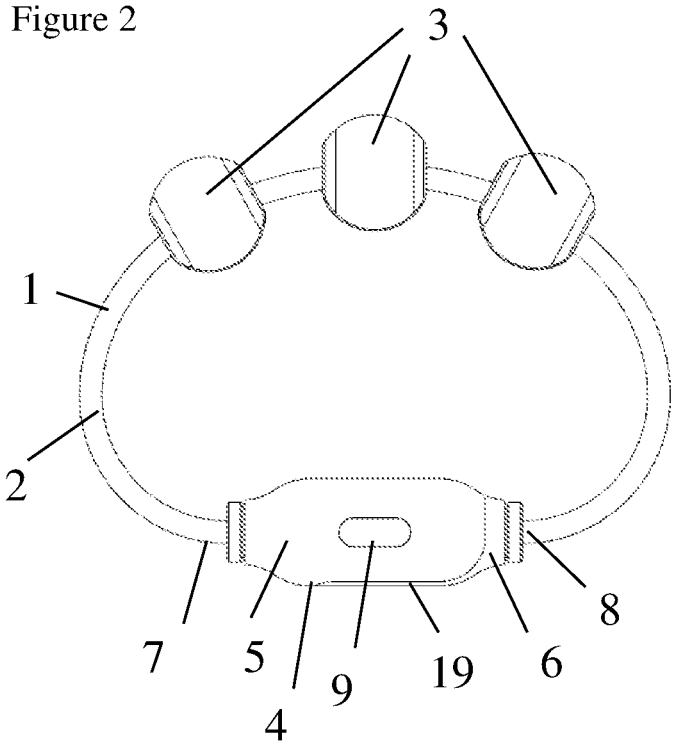
FIG. 2 shows the jewelry article of FIG. 1 in plan view.
Figure 3:
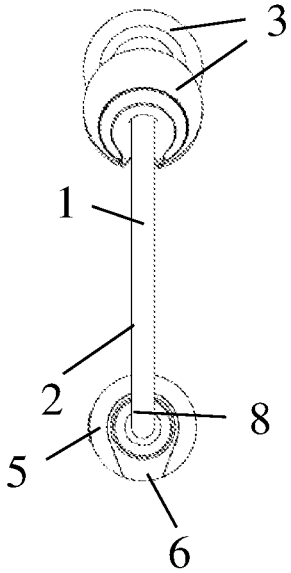
FIG. 3 shows the jewelry article of FIG. 1 in end view.

FIGS. 2 and 3 show further views of one embodiment of jewelry article 1 shown as a bracelet. FIG. 2 shows a plan view, and shows the slot 19 in the female end component 5 through which the male end component 6 can be seen. The clasp 4 is provided with a first push-button fastening means 9, whereby the exterior surface or push-button surface of the first push-button fastening means 9 may be mounted such that in a depressed or neutral condition, the push-button surface is flush with the exterior surface of the female end component 5. It is important that the first push-button fastening means is readily accessible to a wearer of the jewelry article 1 such that when the item is being worn, a user can easily and conveniently depress the first push-button fastening means 9 to release the fastening means, detach the female end component 5 from the male end component 6, and therefore detach the first end 7 from the second end 8 to remove the jewelry article 1.

FIGS. 1, 2 and 3 show three of the same embodiment of ornamental component 3 or charm that are releasably secured or mounted to the elongate member 2 at a desired location throughout the length of the elongate member 2. The ornamental components 3 are configured such that they can be placed onto the elongate member 2 and removed from the elongate member 2 independently of each other, and without a requirement to open the clasp 4 or remove the jewelry article 1. This means that the arrangement of ornamental components 3 can be reordered and rearranged along the elongate member 2 with ease, without the need to open and/or remove the clasp 4 and without the need to take off or remove any of the other ornamental components 3 unless desired.

Figure 4:
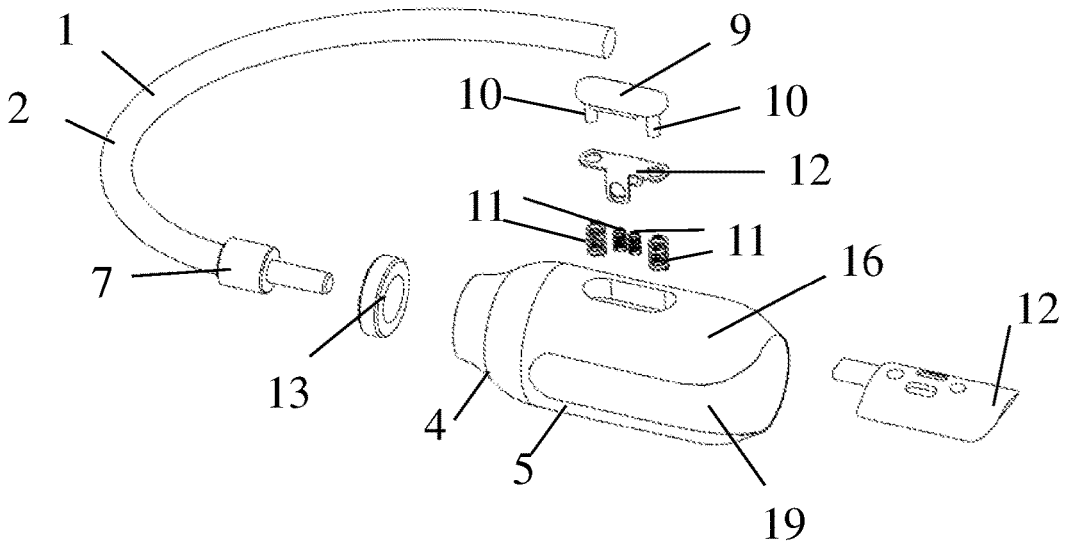
FIG. 4 shows one embodiment of female end component in exploded view.

FIG. 4 shows one embodiment of female end component 5 of the clasp 4 in exploded view. The female end component 5 is show incorporating a washer 13 or ring and push-fit fastening means to the first end 7 of the elongate member 2. The first end 7 is provided with a pin for securing to the female end component 5. The first push-button fastening means 9 comprises at least one engaging portion 10 for engaging with a corresponding fastening means of the male end component 6, not shown in this figure. These engaging portions 10 may form part of the same element as the push-button surface of the first push-button fastening means 9, or may comprise a separate element secured to or operatively connected to the push-button surface of the first push-button fastening means 9. The first push-button fastening means 9 may comprise one or more biasing means 11 configured to return the first push-button fastening means 9 to its original position once the push-button has been released.

The biasing means 11 may comprise one or more springs, and where necessary, the first push-button fastening means 9 may be provided with additional plates 12 or planar portions to support these springs. Alternatively, or in addition to these plates 12, the housing of the female end component 5 may incorporate internal means to support the first push-button fastening means 9 and the at least one biasing means 11.

FIG. 4 shows one embodiment of female end component 5 in exploded view, with one longitudinal slot 19 that provides a cutaway along substantially the length of the female end component 5, and provides a slot 19 in the wall of the female end component 5 to reveal the cavity of the female end component 5 into which the male end component 6 can be releasably secured. An end view of the female end component 5 in such an arrangement would comprise a C-shape. The longitudinal slot 19 may help with locating the male end component 6 within the female end component 5, and may help a user to be sure that the male end component 6 is in the correct position. More than one longitudinal slots 19 may be provided within the walls of the female end component 5. Alternatively, the slot may not pass right through to the opening of the female end component 5, not shown.

Figure 5:
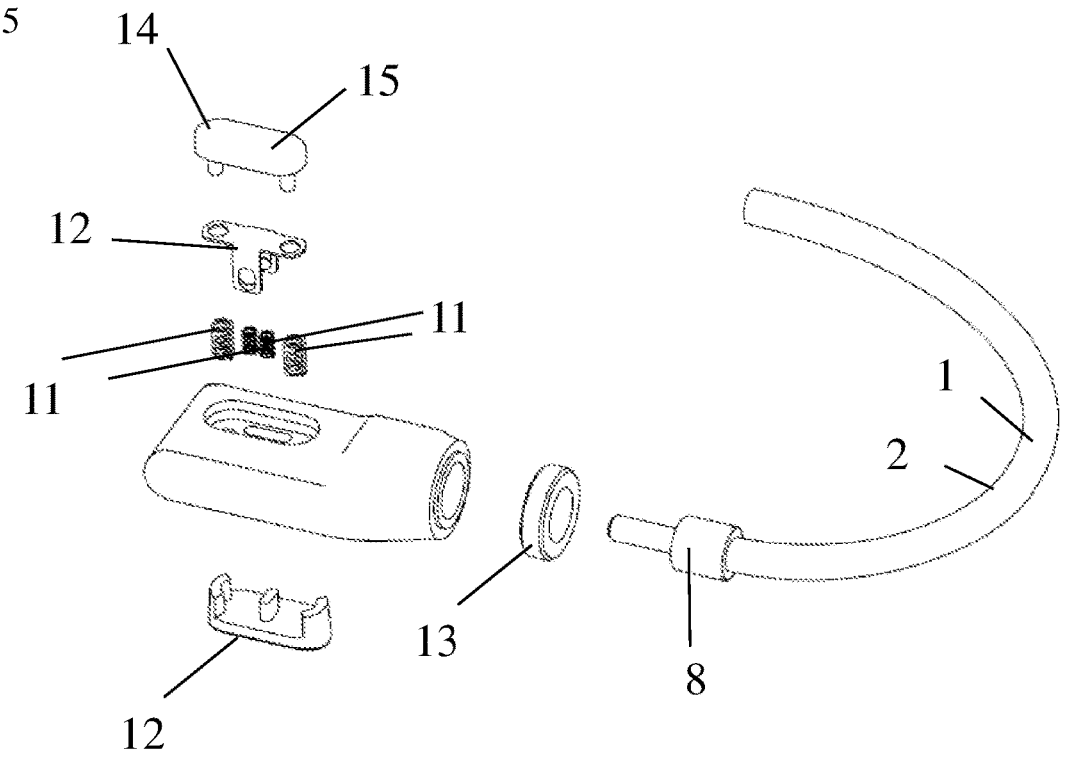
FIG. 5 shows one embodiment of male end component in exploded view.

FIG. 5 shows one embodiment of male end component 6 in exploded view showing one embodiment of second push-button fastening means 14 configured to be mounted such that a surface portion 15 of the second push-button fastening means 14 is provided on an exterior surface of the male end component 17. The surface portion 15 is configured to be engaged with the engaging portions 19 of the first push-button fastening means 9.

The second end 8 of the elongate member 2 is again provided with means for substantially permanently affixing to the male end component 6. The second push-button fastening means 14 comprises at least one biasing means 11, and may also comprise one or more plates 12 for supporting the biasing means 11. The biasing means 11 may comprise a spring as shown. The biasing means 11 returns the surface portion 15 of the second push-button fastening means 14 to a neutral or raised position when the engaging portion 10 of the first push-button fastening means 9 of the female end component 5 is no longer acting on it.

In use, and to join the female end component 5 to the male end component 6, the male end component 6 can be pushed into the end of the female end component 5. The surface portion 15 is raised from the exterior surface of the male end component 17, but configured to be depressed to be flush with the exterior surface of the male end component 17 by the interior surface of the female end component 18 upon entry to the female end component 5. By urging the male end component 6 into the female end component 5, the second push-button fastening means 14 is pressed to allow the male end component 6 to slide into position within the female end component 6. Once in the engaged or locked position, the biasing means 11 of the second push-button fastening means 14, urges the surface portion 15 of the second push-button fastening means back into a raised position. The surface portion 15 of the second push-button fastening means 14 when in a raised position, prevents movement of the male end component 6 in relation to the female end component 5. The surface portion 15 in a raised position abuts against the interior surface of the female end component 18 to prevent movement in a longitudinal direction.

Figure 6:
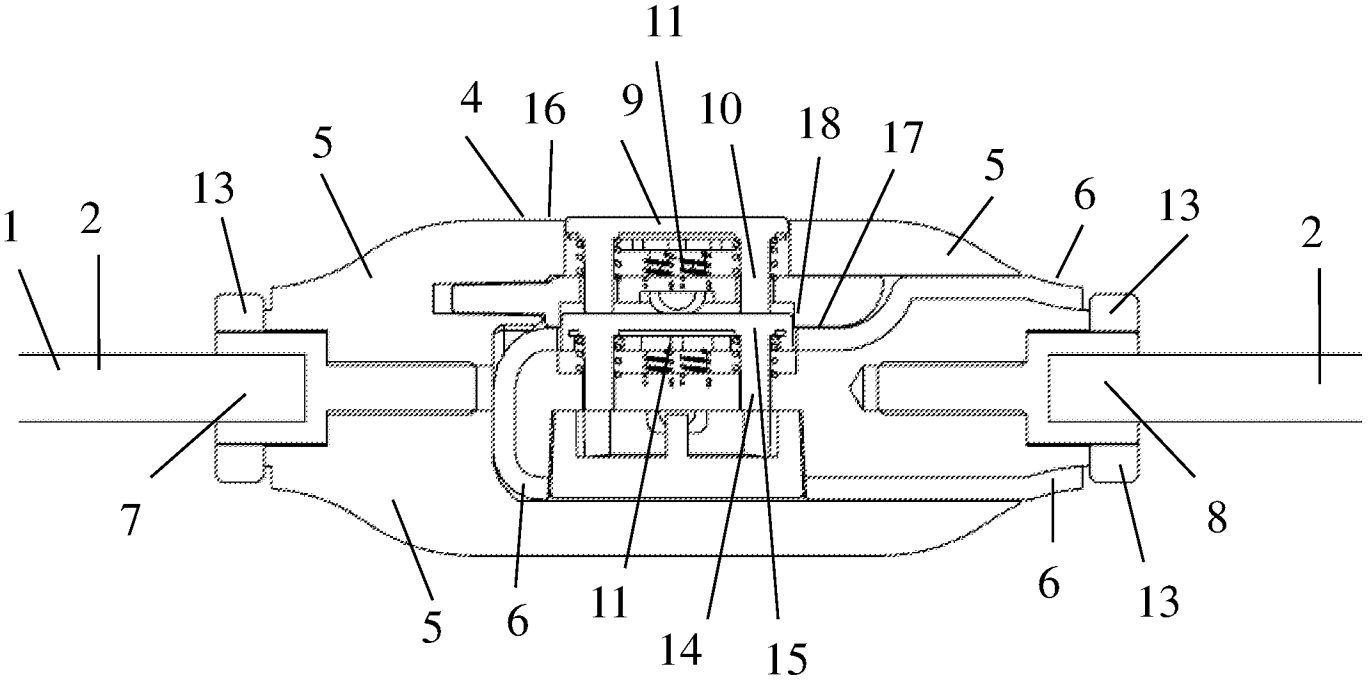
FIG. 6 shows a section view of the female end component of FIG. 4 when in an engaged and locked position with the male end component of FIG. 5.
Figure 7A:
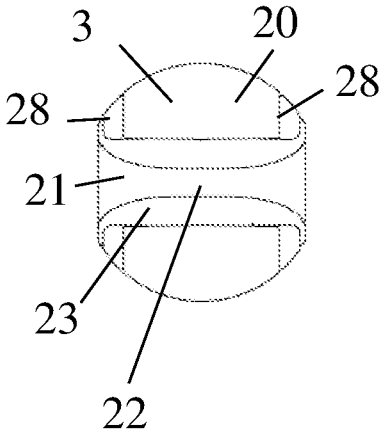
FIG. 7A is a first view of one embodiment of an ornamental component.
Figure 7B:
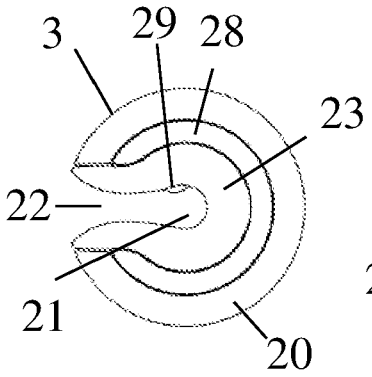
FIG. 7B is a second view thereof.
Figure 7C:
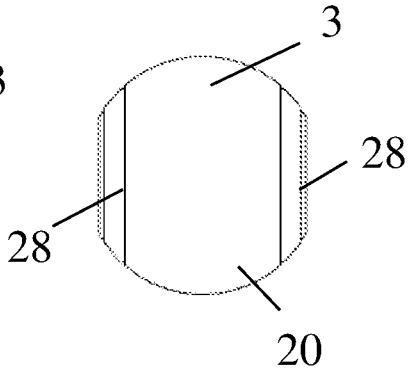
FIG. 7C is a third view thereof.
Figure 7D:
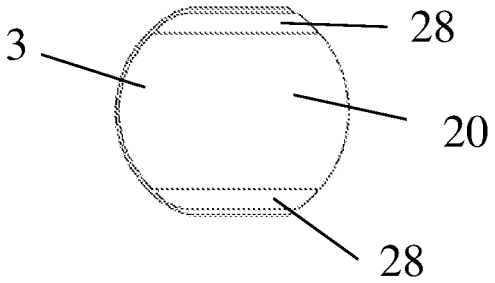
FIG. 7D is a fourth view thereof.
Figure 8:
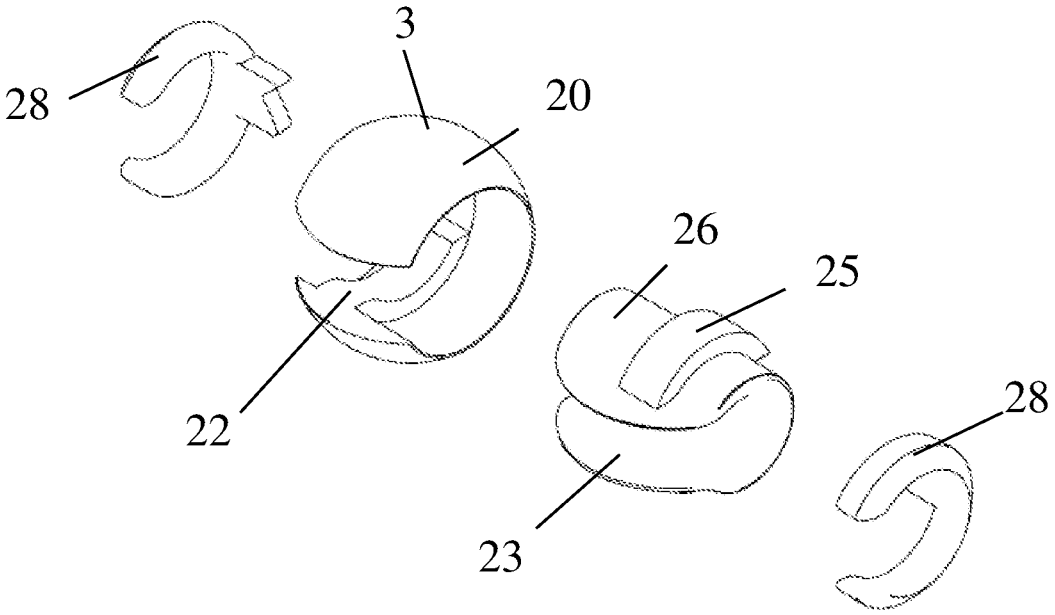
FIG. 8 shows the ornamental component of FIGS. 7A to 7D in exploded view.

FIG. 6 shows a section view of the clasp 4 when the male end component 6 is connected to the female end component 5. This view shows the surface portion 15 raised from the exterior surface of the male end component 17 such that is caught by the interior surface of the female end component 18 and thus preventing from moving in a longitudinal direction.

To release the clasp 4, and disconnect the male end component 6 from the female end component 5, the user presses the push button surface of the first push-button fastening means 9. Depressing the first push-button fastening means 9 causes the engaging portion(s) 10 to act on the surface portion 15 or push button surface of the second push button fastening means 14. The surface portion 15 is moved to a disengaged position, where the surface portion 15 is substantially flush with the exterior surface of the male end component 17, and is no longer caught by the interior surface of the female end component 18. Once the surface portion 15 is no longer in a raised condition, the male end component 6 can be slid out of the female end component 5. The longitudinal slot 19 may provide means to support the user with sliding the male end component 6 free from the female end component 5.

The interior surface of the female end component 18 prevents the surface portion 15 of the second push-button fastening means 14 from returning to a raised position due to the biasing means 11, until the surface portion 15 is outside the female end component 5. Once free from the female end component 5 the biasing means 11 urges the surface portion 15 back into a raised position.

The clasp 4 can therefore be opened and closed, or locked and unlocked, by the wearer without the need for another person's help. The clasp 4 also provides a secure means of securing the article of jewelry 1 to the wearer. The clasp 4 provides an aesthetic feature in its own right. The clasp 4 does not involve fastening means that is intricate and fiddly. The moving parts of the clasp 4 are substantially contained within the female end component 5 and the male end component 6 such that these moving parts are protected from dirt and detritus.

FIGS. 7*a* to 7*d* show one embodiment of ornamental component 3. In its basic form, the ornamental component 3 comprises a C-shaped housing 20, or housing 20 provided with a channel 21 that passes from one end of the housing 20 to another, and a slot 22 that passes through to said channel 21. The channel 21 and slot 22 provide the cut-out that creates the C-shape of the housing 20. The slot 22 is configured to be dimensionally as wide as the elongate member 2 to which it is to be releasably mounted, such that with a little force the ornamental component 3 can be mounted onto the elongate member 2 through the slot 22. The slot 22 allows the ornamental component 3 to pass therethrough albeit with some resistance, such that once the elongate member 2 reaches the channel 21 it cannot unintentionally pass back through the slot 22. The channel 21 is configured to be dimensionally of greater diameter than the elongate member 2 such that the ornamental component 3 can pass along the elongate member 2 of the article of jewelry 1.

The channel 21 of the housing 20 of the ornamental component 3 may be provided with a resilient lining 23, whereby the resilient lining 23 provides a gripping means to the elongate member 2. The resilient lining may be configured to prevent unintentional movement of the ornamental components 3 along the elongate member 2, whilst allowing intentional movement along the elongate member 2, such as when the wearer wishes to rearrange their ornamental components 3 by sliding them along the elongate member 2. The resilient lining 23 may also cover the length of the slot 22, helping to create the resistance to the passage of the elongate member 2. The resilient lining 23 of the channel 21 may be a separate element to the resilient lining 23 of the slot, not shown.

The resilient lining 23 may incorporate one or more protrusions 29, to provide additional stopping means or gripping means to support the ornamental component 3 in position along the elongate member 2. This protrusion 29 may comprise a single elongate ridge that runs along the length of the channel 21. Alternatively, the protrusion 29 may comprise a raised dot.

The housing 20 of the ornamental component 3 may be formed from an aesthetic material and therefore provide aesthetic value. The material may comprise, but not be limited to, any one or more of the following: gemstones, precious stones, precious metals, marble, granite. Alternatively, the housing 20 may incorporate one or more ornamental elements 24 not shown, such as individual gems. These ornamental elements 24 may be sat within a recess in the housing 20 or may be mounted to the surface of the housing 20, not shown.

The ornamental component 3 may incorporate a pair of collars 28 that surround the opening at either end of the channel 21. The collars 28 may support the resilient lining 23 in position. The collars 28 may fit within a recess at each end of the housing 20, and may incorporate means to connect with each other in the middle of the channel 21.

The resilient lining 23 may incorporate a housing engaging projection 25 within the lining exterior surface 26 that fits inside a corresponding recess within the housing 20, to provide a means of supporting the resilient lining 23 in position. The resilient lining 23 may be adhesively bonded to the interior surface of the housing 20.

The invention claimed is:

1. A clasp for an article of jewelry that comprises an elongate member having a first and second opposable ends that are releasably joinable together for applying and removing the article of jewelry on a wearer, the clasp comprising:

a female end component for securing to the first opposable end of the elongate member, the female end component snugly housing a single first push-button fastening means in such a way that a bottom and a side thereof are enclosed by the female end component; and a male end component for securing to the second opposable end of the elongate member and configured to be releasably secured within the female end component, the male end component snugly housing a single second push-button fastening means in such a way that a bottom and a side thereof are enclosed by the male end component, the single second push-button fastening means being configured to be operated by an engaging portion of the first push-button fastening means; wherein:

the first push-button fastening means and second push-button fastening means form a single push-button fastening means within the clasp in such a way that the engaging portion of the first push-button fastening means is moveable between a locked position in which disengagement of the male end component for the female end component is prevented and an unlocked position in which disengagement of the male end component from the female end component is allowed; and depressing a top of the single push-button fastening means detaches the male end component from the female end component therefore detaching the first opposable end of the elongate member from the second opposable end of the elongate member.

2. A clasp according to claim 1, wherein the first push-button fastening means includes at least one biasing means housed within the female end component, the at least one biasing means being configured to urge the engaging portion away from the second push button fastening means in the locked position.

3. A clasp according to claim 1, wherein the second push-button fastening means includes at least one biasing means housed within the male end component, the at least one biasing means being configured to urge a surface portion of the second push-button fastening means into engagement with the engaging portion of the first push-button fastening means in the locked position, wherein the biasing means, surface portion, and engaging portion are positioned along the same axis.

4. A clasp according to claim 1, wherein the first push-button fastening means and the second push-button fastening means each have a respective axis and the axes of the first push-button fastening means and the second push-button fastening means are substantially perpendicular to a longitudinal axis of the female end component and a longitudinal axis of the male end component respectively.

5. A clasp according to claim 1, wherein a push-button surface of the first push-button fastening means is substantially flush with an exterior surface of the female end component when in the locked position.

6. A clasp according to claim 1, wherein a surface portion of the second push-button fastening means protrudes from an exterior surface of the male end component when in the locked position.

7. A clasp according to claim 1, wherein the engaging portion is configured to disengage a surface portion from a locked position to an unlocked position, whereby the surface portion is substantially flush with an exterior surface of the male end component.

8. A clasp according to claim 1, wherein the male end component and/or the female end component comprises a resilient material.

9. A clasp according to claim 1, wherein the female end component comprises at least one longitudinal slot extending along a longitudinal axis of the female end component and the male end component is configured to mate within the at least one longitudinal slot, the at least one longitudinal slot having a substantially C-shaped cross-section viewed along the longitudinal axis.

10. A clasp according to claim 9, wherein the at least one longitudinal slot is disposed in longitudinal alignment with the elongate member and the male end component is visible laterally through the female end component through the at least one longitudinal slot.

11. A clasp according to claim 1, further comprising:

a longitudinal axis extending through the elongate member between the first and second opposable ends and wherein:

the female end component extends through the longitudinal axis from a female end component first end where the female end component is secured to the first end of the elongate member to a female end component second end opposite the female end component first end; and the female end component includes a slot extending along the longitudinal axis and through the second end of the female end component.

12. An article of jewelry comprising:

an elongate member having first and second opposable ends to be releasably joined together for applying and removing the article of jewelry on a wearer, a longitudinal axis extending through the elongate member between the first and second opposable ends, the article of jewelry comprising a clasp comprising:

a female end component secured to the first opposable end of the elongate member, the female end component housing a single first push-button fastening means and including at least one longitudinal slot extending along the longitudinal axis between a female end component first end where the female end component is secured to the first opposable end to a female end component second end opposite the female end component first end, the at least one longitudinal slot extending continuously longitudinally through the female end component second end and laterally through an exterior wall of the female end component, the exterior wall being laterally displaced from the longitudinal axis, thereby providing lateral visibility of the male end component in the at least one longitudinal slot to ensure the male end component is correctly positioned in the at least one longitudinal slot; and the male end component being secured to the second opposable end of the elongate member and configured to be releasably secured within the longitudinal slot, the male end component housing a single second push-button fastening means that is configured to be operated by an engaging portion of the first push-button fastening means; wherein:

the first push-button fastening means and second push-button fastening means form a single push-button fastening means within the clasp in such a way that the engaging portion of the first push-button fastening means is moveable between a locked position in which disengagement of the male end component for the female end component is prevented and an unlocked position in which disengagement of the male end component from the female end component is allowed; and depressing the single push-button fastening means detaches the male end component from the female end component and therefore permits detachment of the male end component from the female end component through the at least one longitudinal slot to remove the article of jewelry.

13. An article of jewelry according to claim 12, wherein the at least one longitudinal slot forms a substantially C-shaped cavity in the female end component viewed at the female end component second end along the longitudinal axis.

14. An article of jewelry according to claim 12, wherein the exterior wall extends longitudinally from the female end component first end and female end component second end and the at least one longitudinal slot extends through the exterior wall between the female end component first end and female end component second end.

* * * * *